US009767972B2

(12) United States Patent
Peng

(10) Patent No.: US 9,767,972 B2
(45) Date of Patent: Sep. 19, 2017

(54) IN-LINE SLIDE SWITCH

(71) Applicant: Rich Brand Industries Limited, Dongguan, Guangdong Province (CN)

(72) Inventor: Te-Shui Peng, Taoyuan (TW)

(73) Assignee: Rich Brand Industries Limited, Dongguang (CN)

( * ) Notice: Subject to any disclaimer, the term of this patent is extended or adjusted under 35 U.S.C. 154(b) by 0 days.

(21) Appl. No.: 14/941,801

(22) Filed: Nov. 16, 2015

(65) Prior Publication Data

US 2017/0140884 A1 May 18, 2017

(51) Int. Cl.

| | |
|---|---|
| ***H01H 15/04*** | (2006.01) |
| ***H01H 15/00*** | (2006.01) |
| ***H01H 15/24*** | (2006.01) |
| ***H01H 9/02*** | (2006.01) |
| ***H01R 4/24*** | (2006.01) |
| ***H01H 1/58*** | (2006.01) |

(52) U.S. Cl.

CPC ..... *H01H 15/04* (2013.01); *H01H 1/585* (2013.01); *H01H 9/0228* (2013.01); *H01H 15/005* (2013.01); *H01H 15/24* (2013.01); *H01R 4/2412* (2013.01); *H01H 2221/014* (2013.01); *H01H 2231/052* (2013.01)

(58) Field of Classification Search

CPC ..... H01H 15/04; H01H 15/24; H01H 15/005; H01H 1/585; H01H 2231/052; H01R 4/24; H01R 4/2416; H01R 4/2412

USPC ..... 439/409; 200/547, 548

See application file for complete search history.

(56) References Cited

U.S. PATENT DOCUMENTS

| | | | | |
|---|---|---|---|---|
| 5,051,549 | A * | 9/1991 | Takano | H01H 15/06 200/16 C |
| 5,499,930 | A * | 3/1996 | Cieri | H01R 12/67 439/374 |
| 6,350,161 | B2 * | 2/2002 | Lacoy | H01R 13/518 439/701 |
| 6,682,363 | B1 * | 1/2004 | Chang | H01R 24/64 439/409 |
| 7,465,184 | B2 * | 12/2008 | Scherer | H01R 4/2433 439/408 |
| 7,547,226 | B2 * | 6/2009 | Koessler | H01R 4/2433 439/409 |
| 7,985,094 | B2 * | 7/2011 | Dennes | H01R 4/2433 439/409 |

* cited by examiner

*Primary Examiner* — Felix O Figueroa

(74) *Attorney, Agent, or Firm* — Alan D. Kamrath; Kamrath IP Lawfirm, P.A.

(57) ABSTRACT

An in-line slide dimming switch includes a switch and dimming circuit installed on a printed circuit board (which is installed in the in-line slide dimming switch) and operated with a dimmable energy-saving fluorescent bulb and a dimmable LED bulb, so that the in-line slide dimming switch may adjust the light emitting brightness of the dimmable energy-saving fluorescent bulb and the dimmable LED bulb installed onto a lamp holder. With the wire holders installed at both ends, a power cable is installed conveniently to achieve the effects of shortening the assembling procedure, and improving the assembling efficiency and the market competitiveness.

6 Claims, 7 Drawing Sheets

IN-LINE SLIDE SWITCH

BACKGROUND OF THE INVENTION

Field of the Invention

The present invention relates to an in-line slide dimming switch and, more particularly, to the in-line slide dimming switch capable of directly dimming a dimmable energy-saving fluorescent bulb and a dimmable LED bulb connected to a lamp holder and connecting an electric wire conveniently to achieve the effects of shortening the assembling procedure, and improving the assembling efficiency and market competitiveness.

Description of the Related Art

Lamps are one of the necessary electric appliances in our life and mainly used for providing light, and various common lamps include table lamps, nightlights, fluorescent lamps, etc. A common conventional lamp is comprised of a lamp body and an in-line switch connected to the lamp, and the in-line switch may be turned, pressed or pushed to turn ON and OFF the lamp, so that a light emitting element installed in the lamp is lit or extinguished. In other words, the early conventional in-line switch just has the function of turning ON and OFF the current, but it cannot adjust the brightness of the light emitting element of the lamp. With the advent of the diversification of people's lives, users have different light emitting brightness requirements on the lamp holder. To cope with the market requirements, an in-line dimming switch is developed and sold in the market, and such in-line dimming switch is provided for adjusting the light emitting brightness of the bulb of the lamp. However, the conventional in-line slide dimming switch is operated by pushing a slide member to adjust and change the property (such as the resistance) of a passing current, to adjust the intensity of the brightness of the lamp. Therefore, the conventional in-line dimming switch is only applicable for an incandescent bulb of higher power consumption and inapplicable for an energy-saving fluorescent bulb or LED bulb with higher brightness and better energy saving effect.

As science and technology advance, various light emitting elements are developed, and a dimmable energy-saving fluorescent bulb and a dimmable LED bulb are introduced to the market.

The energy-saving fluorescent bulb and LED bulb also come with a mechanism for changing the brightness. However, the aforementioned conventional in-line slide dimming switch cannot be used together with the high-tech dimmable energy-saving fluorescent bulb and dimmable LED bulb, so that it is necessary to design and develop an in-line slide dimming switch for the dimmable energy-saving fluorescent bulb and the dimmable LED bulb to expand the scope of applicability and meet the requirement of consumers.

In addition, the conventional in-line switch or in-line slide dimming switch generally comprises a base, a cover and an electrical connecting module installed therein. When the power cable is installed, it is necessary to loosen the bold to remove the cover from the base. Both ends of the power cable are processed into bare ends, extended into the base, and screwed with the electrical connecting module by a bold or soldered with the electric connecting module by a solder gun. Then the cover is covered onto the base, and the bold is locked to complete the operation of connectingthe electric wire. Obviously, the aforementioned operation of connecting the electric wire is cumbersome, thus resulting in a low assembling efficiency which is unfavorable to the improvement of the market competitiveness.

SUMMARY OF THE INVENTION

Therefore, it is a primary objective of the present invention to provide an in-line slide dimming switch capable of directly dimming a dimmable energy-saving fluorescent bulb and a dimmable LED bulb connected to a lamp holder.

Another objective of the present invention is to provide an in-line slide dimming switch capable of connecting an electric wire conveniently to achieve the effects of shortening the assembling procedure, and improving the assembling efficiency and market competitiveness.

To achieve the aforementioned and other objectives, the present invention provides an in-line slide dimming switch comprising a base, a cover, a printed circuit board and a plurality of wire holders. The base is a casing with a hollow formed at the top of the base, a large accommodating space formed inside the base, a pivoting frame formed separately at left and right ends of the base, an accommodating space penetrating from top to bottom in the pivoting frame and passing out from an outer side of the base, a separating ridge formed at the center of a surface of an inner sidewall and extended from top to bottom, a latching ridge transversally disposed on an outer surface of the outer sidewall member, and a pivoting slot formed at the bottom edge of both sidewalls of the inner sidewall. The cover is a casing with a hollow formed at the bottom of the cover and covered and engaged with the base the base, and a large accommodating space is formed therein, and a longitudinal slide slot is formed at the top of the large accommodating space and a groove being formed on each of the left and right end surfaces of the large accommodating space. The printed circuit board has a switch and dimming circuit and a potentiometer electrically coupled to each other. The potentiometer is provided for adjusting the electric potential of a sliding handle situated at a position higher than the printed circuit board, so that a pushing member of a slide member may be pushed to drive the sliding handle to move. An accommodating recess is formed at the left and right ends of the printed circuit board and large enough to frame the pivoting frame on both sides of the base. A conductive plate is installed above the accommodating recess and electrically coupled to the switch and dimming circuit, and a conductive tip is formed and extended outwardly from an inner side of the conductive plate. The printed circuit board is installed horizontally into the large accommodating space of the base, and the accommodating recesses on both sides frame the pivoting frames on both sides of the base respectively. The quantity of the wire holders is two, and the two wire holders are installed symmetrically sideways. A pivoting shaft is extended out from the inner side of the bottom wall of each wire holder towards both sides to enter into the pivoting slot of the base to define a pivoting status, and an inner sidewall is disposed at the top of the pivoting shaft and has a separating ridge formed at the center of the outer side of the inner sidewall. An outer end of the bottom wall is extended upward to form an outer sidewall, and a latching edge is formed at the inner edge. A block is coupled between the inner sidewall and the outer sidewall, and an insert hole is penetrated through the inner sidewall and the outer sidewall.

In the aforementioned in-line slide dimming switch, the base has a through hole formed separately at four corners and penetrated from top to bottom and provided for passing the connecting member from bottom to top, and a stepped surface having a height on the inner side greater than the height on the outer side. A downwardly hollow locking hole pillar is separately formed at the four corners and has an inner thread formed therein. The position of the stepped surface is configured to be corresponsive to the through hole of the base, and the periphery having the stepped surface with a height on the inner side greater than the height on the outer side is configured to be corresponsive to the stepped surface of the base. The cover includes a plurality of positioning pillars. The stepped surface of the cover is configured to be corresponsive to the stepped surface of the base, while the locking hole pillar of the cover is configured to be corresponsive to the through hole of the base. The recesses at both ends of the cover are configured to be corresponsive to the outer sidewall of the base, and the locking hole pillar is covered onto the base, so that the pushing bump of the printed circuit board is protruded out from the slide slot of the cover. Then the connecting members are passed through the through hole of the base and locked with the locking hole pillar of the cover.

In the aforementioned in-line slide dimming switch, the base has a plurality of upwardly protruding support pillars disposed therein. When the printed circuit board is horizontally placed in the large accommodating space of the base, the bottom side of the printed circuit board sits on the support pillars stably for positioning.

In the aforementioned in-line slide dimming switch, the pivoting shaft of the wire holder has a bevel to facilitate entering the base into a pivoting slot of the base by a rotary motion.

In the aforementioned in-line slide dimming switch, the inner top edge of the outer sidewall of the wire holder is formed to be a bevel, and a though hole is formed at the bottom of the wire holder.

In the aforementioned in-line slide dimming switch, the latching edge on the outer sidewall of the wire holder is formed at the inner top edge of the through hole.

DETAILED DESCRIPTION OF THE PREFERRED EMBODIMENTS

Figure 1:
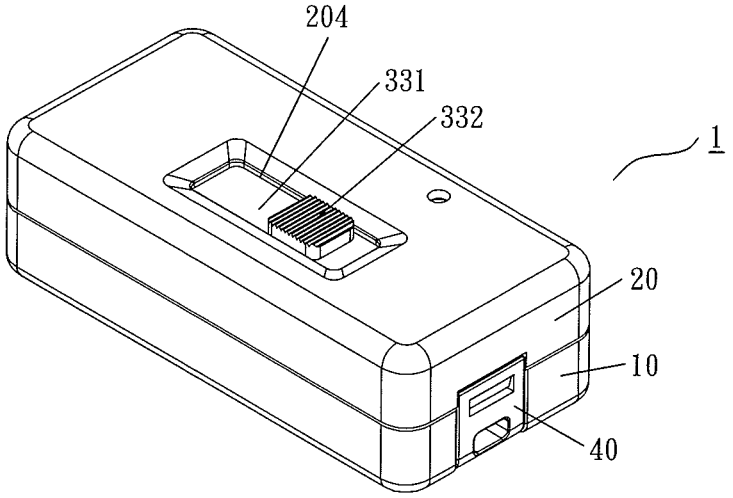
FIG. 1 is a top view of a preferred embodiment of the present invention.
Figure 2:
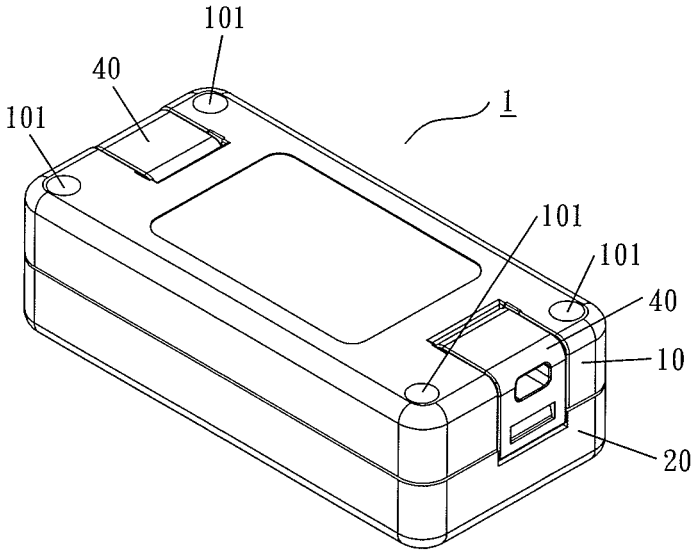
FIG. 2 is a bottom view of a preferred embodiment of the present invention.
Figure 3:
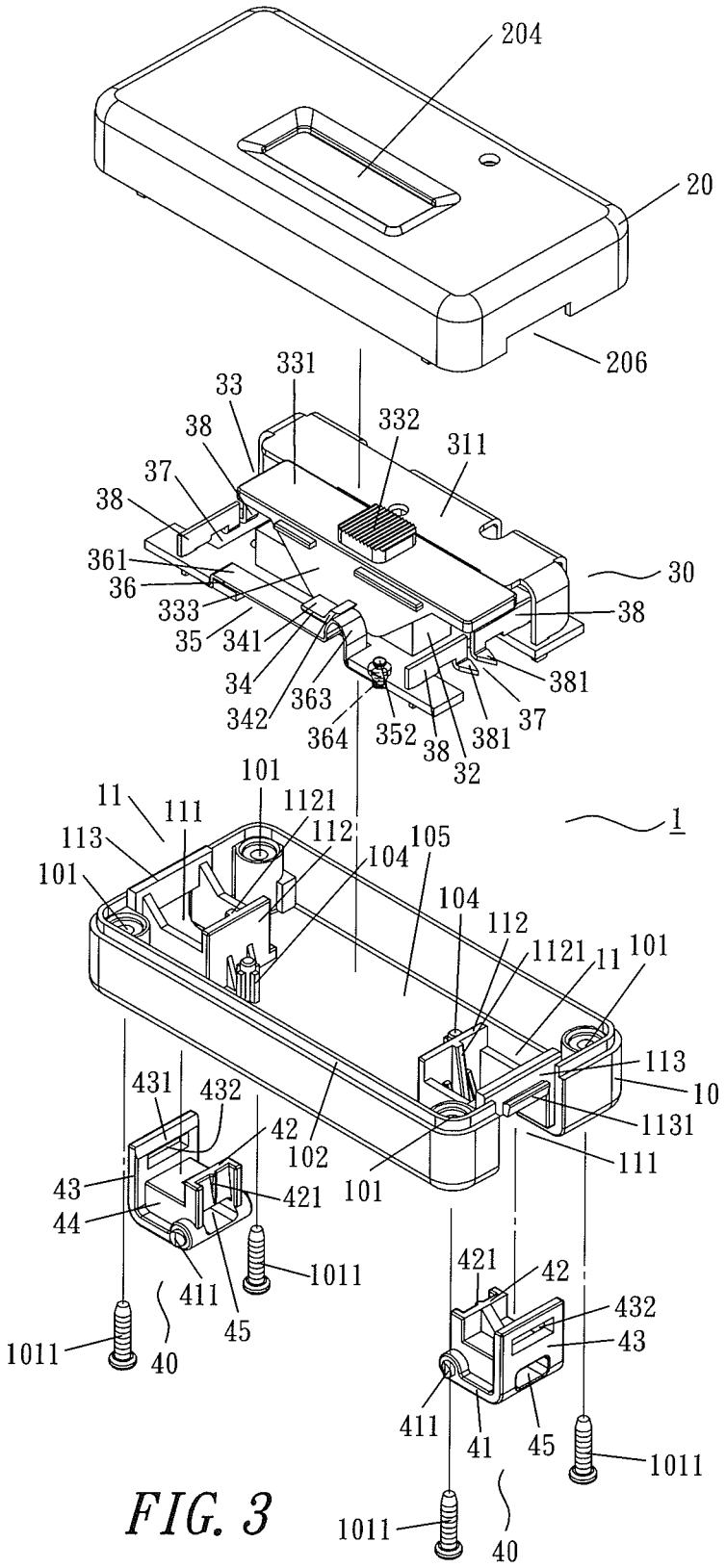
FIG. 3 is an exploded top view of a preferred embodiment of the present invention.

The technical characteristics, contents, advantages and effects of the present invention will be apparent with the detailed description of preferred embodiments accompanied with related drawings as follows.

The present invention provides an in-line slide dimming switch 1 comprising a base 10, a cover 20, a printed circuit board 30 and a plurality of wire holders 40.

Figure 4:
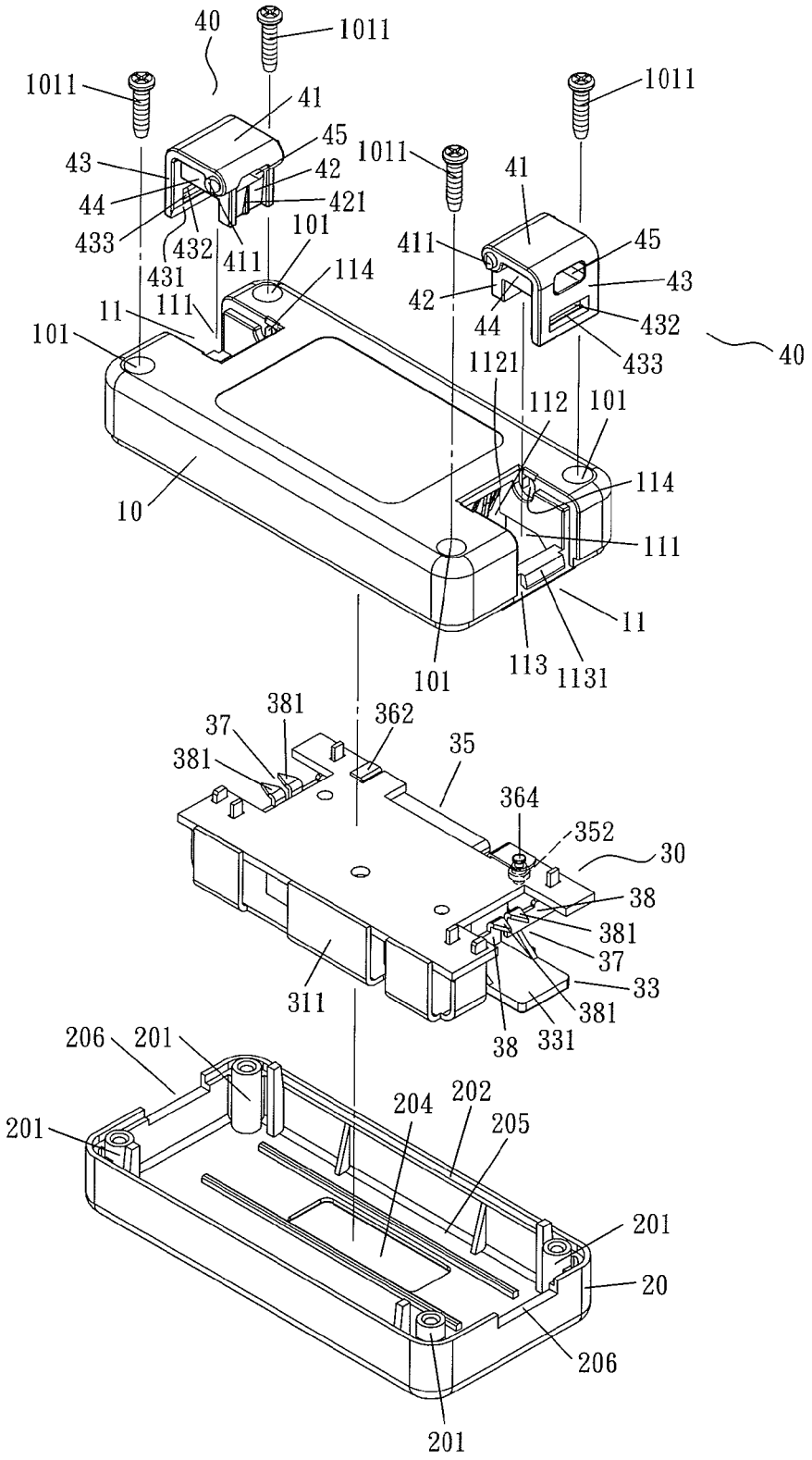
FIG. 4 is an exploded bottom view of a preferred embodiment of the present invention.

In FIGS. 1 to 4, the base 10 is a casing with a hollow formed at the top of the casing, a through hole 101 formed at each of the four corners of the base 10 and penetrated from top to bottom for connecting a connecting member 1011 (such as a bolt), and a stepped surface 102 with the height on the inner side greater than the height on the outer side. One or more (such as two) upwardly protruding support pillars 104 form a large accommodating space 105. A pivoting frame 11 is formed separately at left and right ends of the base 10, and an accommodating space 111 penetrates through the pivoting frame 11 from top to bottom and passes out from an outer side of the base 10. A separating ridge 1121 is formed at the center of a surface of the inner sidewall 112 and extends from top to bottom. A latching ridge 1131 is transversally disposed on an outer surface of the outer sidewall 113, and a pivoting slot 114 is formed at the bottom edge of both sidewalls of the inner sidewall 112 (as shown in FIG. 4).

In FIGS. 1 to 4, the cover 20 is a casing with a hollow formed at the bottom of the cover 20. A downwardly hollow locking hole pillar 201 is formed separately at four corners of the cover 20 and has an inner thread (as shown in FIG. 4), and their position is corresponsive to the through hole 101 of the base 10. The periphery of the cover has a stepped surface 202 with the height on the inner side greater than the height on the outer side and configured to be corresponsive to the stepped surface 102 of the base 10. A longitudinal slide slot 204 is formed at the top of the cover 20, and a large accommodating space 205 is formed in the cover 20. A recess 206 is formed separately on both left and right end surfaces of the cover 20.

Figure 6:
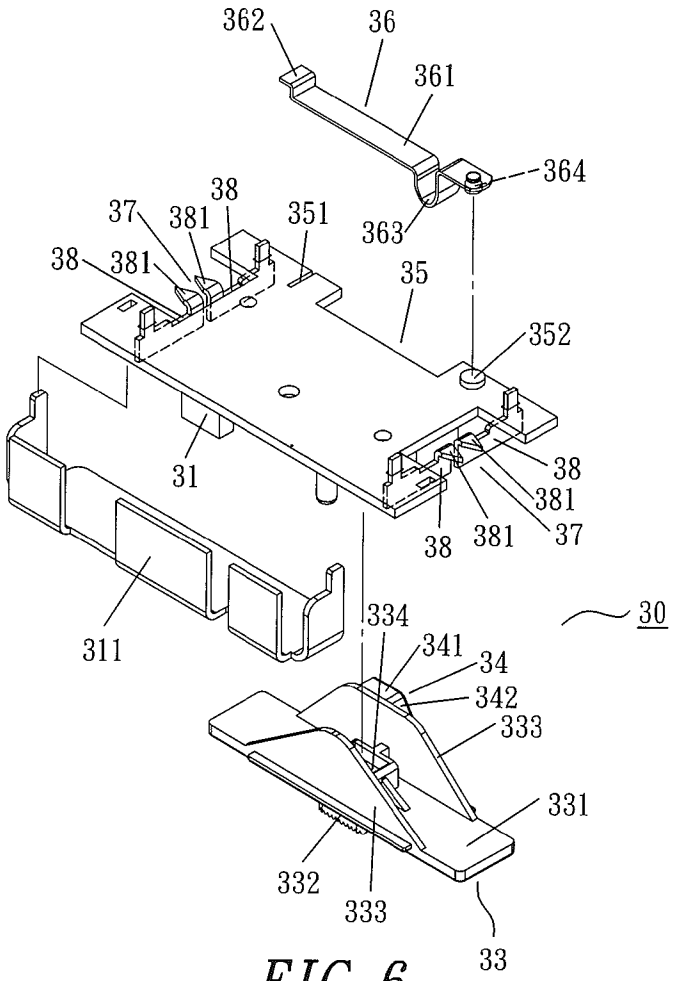
FIG. 6 is an exploded bottom view of a printed circuit board of a preferred embodiment of the present invention.
Figure 5:
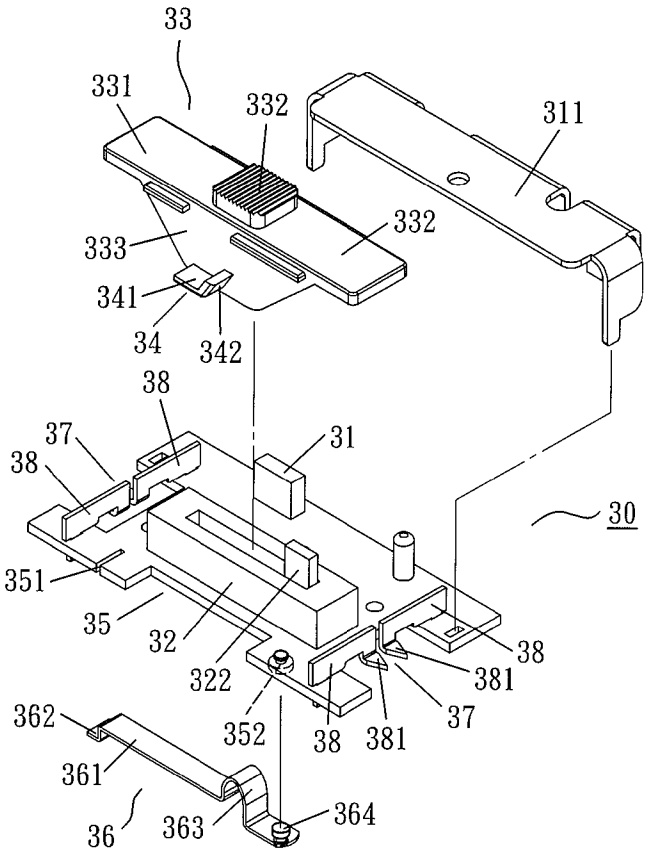
FIG. 5 is an exploded top view of a printed circuit board of a preferred embodiment of the present invention.
Figure 7:
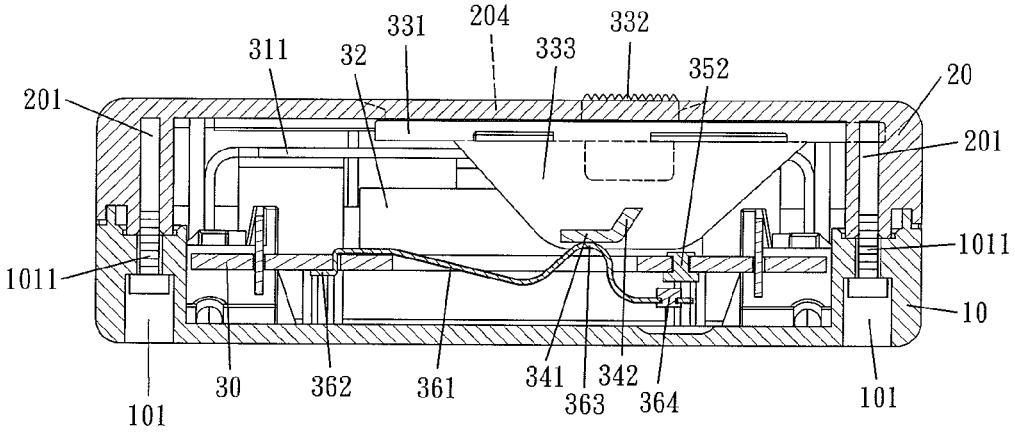
FIGS. 7 to 9 are schematic views showing the operation of a slide member and an elastic member in accordance with a preferred embodiment of the present invention.
Figure 8:
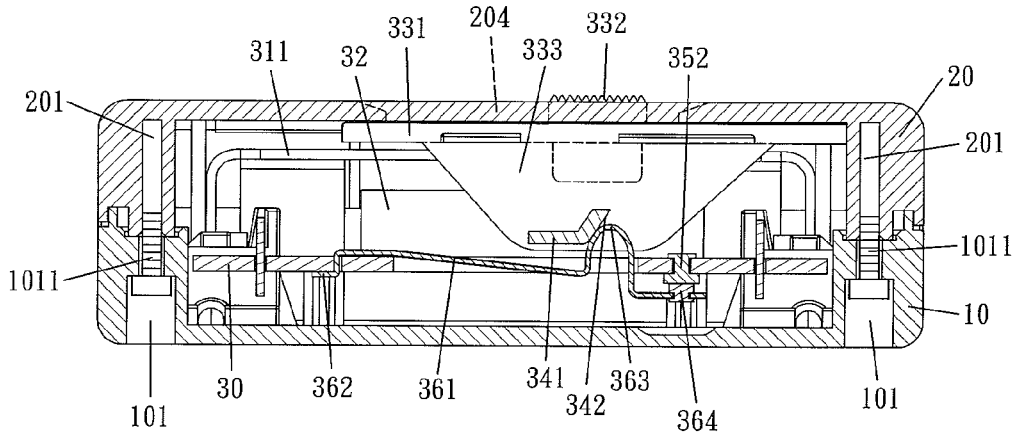
Figure 9:
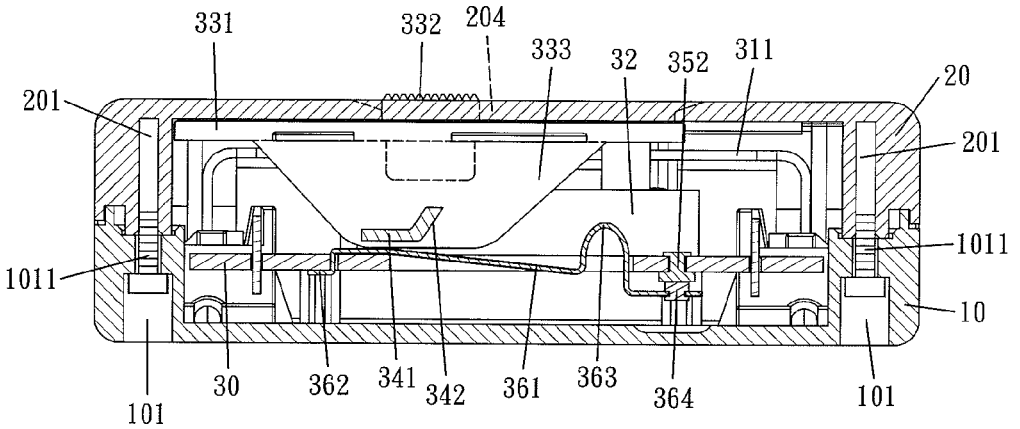

In FIGS. 1~6, the printed circuit board 30 comprises a switch and dimming circuit 31 which is a circuit provided for dimming a dimmable energy-saving fluorescent bulb and a dimmable LED bulb directly. A heat dissipating plate 311 is covered onto the switch and dimming circuit 31. A slidable potentiometer 32 is installed adjacent to the heat dissipating plate 311 of the printed circuit board 30, and the potentiometer 32 and the switch and dimming circuit 31 are electrically coupled to each other. By moving a sliding handle 322 of the potentiometer 32, the dimmable energy-saving fluorescent bulb and the dimmable LED bulb connected to the switch and dimming circuit 31 can be turned on or off and dimmed. A slide member 33 is installed on the sliding handle 322 of the potentiometer 32, and the slide member 33 has a top wall 331, an upwardly protruding pushing bump 332 disposed at the middle of the slide member 33, and the top side is designed with a friction surface to facilitate users to push the slide member 33. The pushing bump 332 is configured to be corresponsive to the slide slot 204 of the cover 20. Each of the front and back side of the top wall 331 is dropped to form a peripheral wall 333, and the two peripheral walls 333 define a space with a gap sufficient to cover the potentiometer 32 from top to bottom. The bottom of the top wall 331 has an upwardly extended insert slot 334 (as shown in FIG. 6). Thus, when the slide member 33 is covered onto the potentiometer 32, the sliding handle 322 of the potentiometer 32 is inserted upwardly into the insert slot 334 to achieve the connection, so that when a user pushes the pushing bump 332 by a finger to drive whole slide member 33 to slide to the left or right side, the insert slot 334 of the slide member 33 drives the sliding handle 322 to move in a longitudinal direction. A positioning member 34 is fixed on an outer sidewall of a peripheral wall 333 and divided into a horizontal portion 341 and an oblique portion 342. A groove 35 is formed on the printed circuit board 30 adjacent to the potentiometer 32. A clip groove 351 is formed on a side of the groove 35, and a first electric contact point 352 (such as a sliver contact) is formed on the other side by soldering through a hole. An elastic member 36 is installed on the groove 35 and divided into a horizontal portion 361. A lateral end is bent downwardly to form a pin portion 362, and the other side is bent upwardly to form an arc supporting portion 363 whose downward end is bent outward. A hole on the elastic member 36 is soldered to form a second electric contact point 364 (such as a silver contact). During installation as shown in FIGS. 7~9, the pin portion 362 of the elastic member 36 is inserted into the clip groove 351 and positioned and communicated to the switch and dimming circuit 31 by soldering. The second electric contact point 364 at the other end is passed through the groove 35 and placed horizontally at the bottom of the lateral edge, and the second electric contact point 364 is configured to be corresponsive to the first electric contact point 352 (as shown in FIGS. 8~9).

When the pushing bump 332 is pushed to drive the slide member 33 to link the sliding handle 322 to move longitudinally, the positioning member 34 will move with the slide member 33 and slide sideways. When the positioning member 34 is moved to the right (as indicated in FIG. 7) to the oblique portion 342 and touches the supporting portion 363 of the elastic member 36 as shown in FIG. 8, a force is applied again to move the positioning member 34 to the right as shown in FIG. 7, the process is changed from FIG. 8 into FIG. 7, and the component force produced by pushing the oblique portion 342 of the positioning member 34 will press the supporting portion 363 downward until the horizontal portion 341 presses the supporting portion 363. Now, the second electric contact point 364 is separated from the first electric contact point 352 as it descends with the supporting portion 363, and the operation of separating the first and second electric contact points 352, 364 is equivalent to disconnect the power of the connected dimmable energy-saving fluorescent bulb and dimmable LED bulb switch and dimming circuit 31 to turn off the bulbs. When the force is applied in an opposite direction as shown in FIG. 7, the pushing bump 332 drives the slide member 33 to link the sliding handle 322 to move to the left and reach the position as shown in FIG. 8. Now, the oblique portion 342 of the positioning member 34 stops applying force to press the supporting portion 363, so that the supporting portion 363 will return to its original position by its resilience, and the second electric contact point 364 will be attached to the first electric contact point 352 immediately. Such operation is equivalent to turning on the power of the dimmable energy-saving fluorescent bulb and dimmable LED bulb connected to the switch and dimming circuit 31 to light up the bulbs. However, if the pushing bump 332 is pushed further, the slide member 33 is driven to link the sliding handle 322 to move to the left. Now, the potential produced by the movement of the sliding handle 322 is changed, and the control of the switch and dimming circuit 31 changes the brightness slightly. Until the slide member 33 is moved to the position as shown in FIG. 9, a maximum brightness is reached.

In FIGS. 3~6, an accommodating recess 37 is formed separately at both left and right ends of the printed circuit board 30, and each of them preferably comes with a size sufficiently for framing the pivoting frames 11 on both sides of the base 10. A conductive plate 38 is installed at the top of the accommodating recess 37 and electrically coupled to the switch and dimming circuit 31, and an inner end of the conductive plate 38 is extended outward to form a conductive tip 381.

Figure 10:
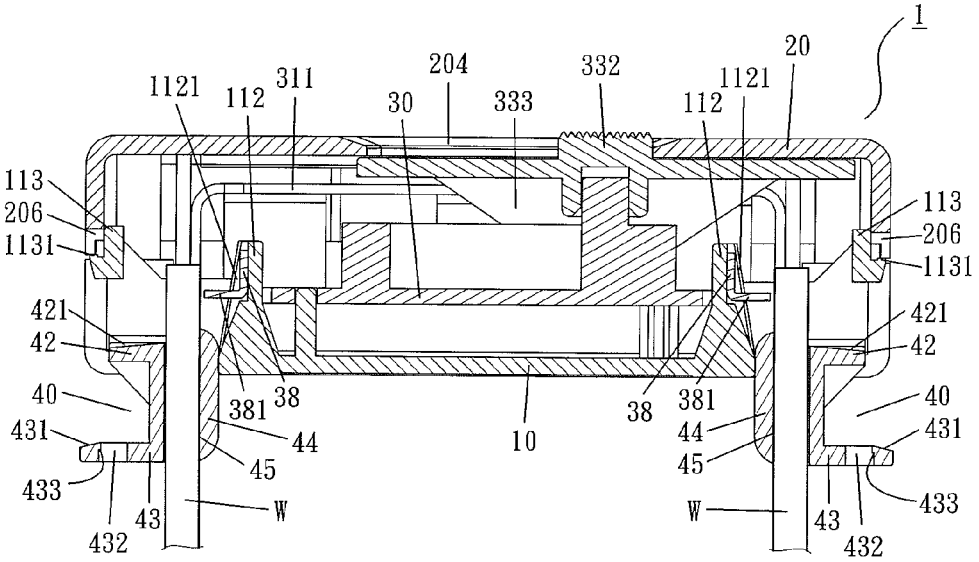
FIG. 10 is a front view showing the process of installing a power cable to a wire holder in accordance with a preferred embodiment of the present invention.
Figure 11:
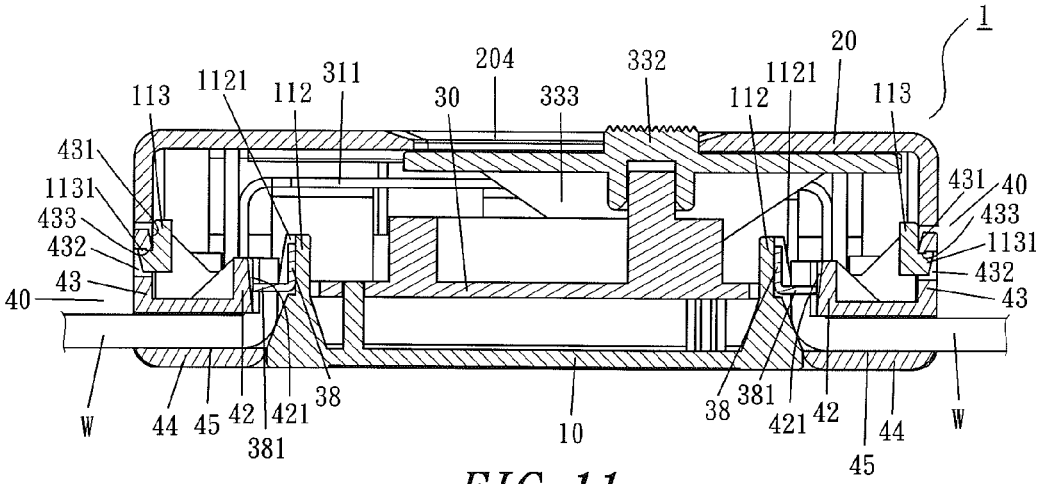
FIG. 11 is a front view of a power cable being connected to a wire holder in accordance with a preferred embodiment of the present invention.

In FIGS. 3~4 and 10~12, there are two wire holders 40 symmetrically on left and right sides. A pivoting shaft 411 is extended out from two sides of an inner end of the bottom wall 41 of each wire holder 40 and has a bevel to facilitate the pivoting slot 114 of the base 10 to be entered by rotation to define a pivoting status. An inner sidewall 42 is connected to the top of the pivoting shaft 411, and the middle of the outer side of the inner sidewall has a separating ridge 421. An outer sidewall 43 is extended upwardly from an outer end of the bottom wall 41, a bevel 431 is formed at the inner top, and a through hole 432 is formed therebelow. The bevel 431 is provided for applying force to shift the whole wire holder 40, and the inner top of the through hole 432 further has a latching edge 433 (as shown in FIGS. 4 and 11). A block 44 is connected between the inner sidewall 42 and the outer sidewall 43, and an insert hole 45 is formed therein and penetrated through the inner sidewall 42 and the outer sidewall 43.

During assembling, the printed circuit board 30 (comprised of the switch and dimming circuit 31, the slide member 33, the positioning member 34, the groove 35, the elastic member 36, the accommodating recess 37 and the conductive plate 38) is placed horizontally into the large accommodating space 105 of the base 10 and sits on the support pillars 104 stably for positioning. During the process, the accommodating recesses 37 on both sides of the printed circuit board 30 are provided for framing the pivoting frames 11 on both sides of the base 10, while two conductive tips 381 on the same side are separated by the separating ridge 1121 of the inner sidewall 112 of the same side for positioning. Then the wire holders 40 on both sides are rotated by their pivoting shaft 411 into the pivoting slot 114 on both sides of the base 10, so that the wire holders 40 are pivoted with the base 10 by using the pivoting shaft 411 as an axis. Now, the latching edge 433 of the wire holders 40 is still not latched with the latching ridges 1131 on both sides of the base 10, so that the wire holders 40 are drooped naturally by gravity.

Finally, the stepped surface 202 of the cover 20 is configured to be corresponsive to the stepped surface 102 of the base 10, while the locking hole pillar 201 is configured to be corresponsive to the through hole 101 of the base 10. The recess 206 is configured to be corresponsive to the outer sidewall 113 of the base 10, and the cover 20 is covered and engaged with the base 10. Now, the pushing bump 332 on the printed circuit board 30 will slightly protrude out from the slide slot 204 of the cover 20 without being in contact with the slide slot 204. Then the connecting members 1011 (such as bolts) are passed from bottom to top through the through hole 101 of the base 10 and locked with the locking hole pillar 201 of the cover 20, to complete assembling the whole in-line slide dimming switch 1.

During use, the wire holders 40 at both ends of the in-line slide dimming switch 1 are provided for connecting a power cable. Such power cable is two wires, and each wire includes a conductive wiring harness and an insulating plastic coating covering the exterior of the wiring harness. During manufacture, the insulating plastic coatings of the two wires are glued with one another, so that a small section of the starting ends of the two wires may be torn away to facilitate peeling off a small section of the insulating plastic coating to expose the conductive wire bundle to form a bare end, and allowing users to connect the bare end with the wire holder. It is prior art to process the end of the wire to form the bare end, but this disclosure needs not to process the end of the wire to form the bare end and just connects the wire to a power supply directly.

Figure 12:
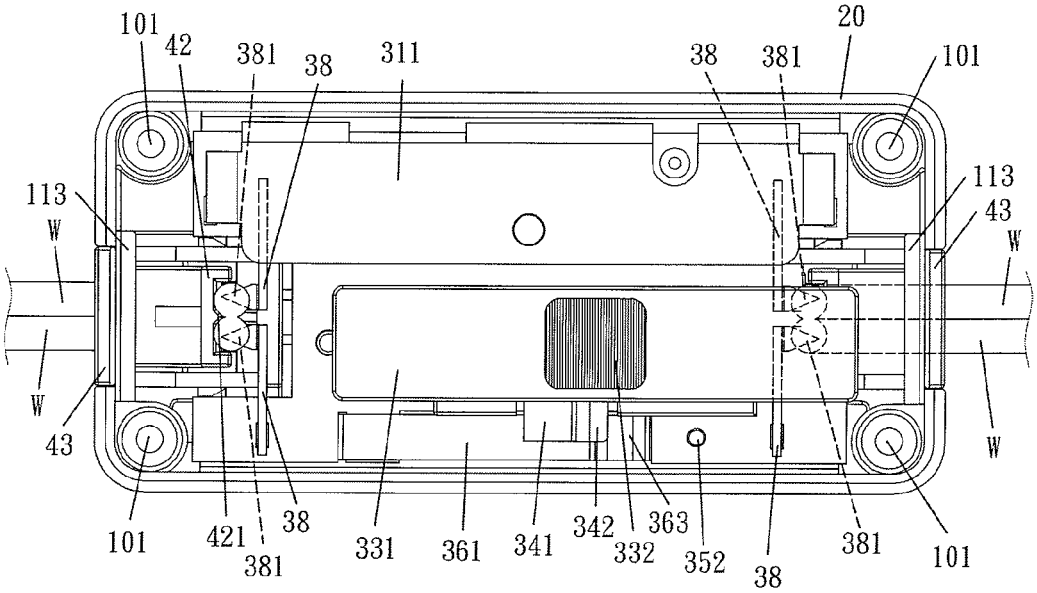
FIG. 12 is a bottom view of a power cable being connected to a wire holder in accordance with a preferred embodiment of the present invention.

In FIG. 10, when the wire holders 40 are drooped naturally during the power connection, the power cables W (two wired cable) is passed from bottom to top (or from the outside to the inside) from the insert hole 45 of the wire holders 40 and inserted to a distance directly, so that the conductive tips 381 of the conductive plates 38 abut the outer wall of the wire without piercing the insulating plastic coating. In FIGS. 11 and 12, the wire holder 40 is shifted upward by using the pivoting shaft 411 as an axis until the latching edge 433 of the wire holder 40 and the latching ridge 1131 of the base 10 are latched with each other. During the process, the wire holder 40 drives the powercable W to shift or displace accordingly. The wire remaining in the insert hole 45 will shift with the insert hole 45 from a vertical status to a horizontal status. The wire entered into the accommodating space 111 of the base 10 is moved with the wire holder 40 towards the inner side, and the inner sidewall 42 of the wire holder 40 is shifted to touch and push the wire of the power cable W towards the inner side. During the process, the separating ridge 421 of the inner sidewall 42 will separate the two wires of the power cable W, and the two wires of the power cable W will touch the conductive tip 381 of the conductive plates 38. Thus, the conductive tips 381 remain still, but the wire is forced to move towards the inner side, so that the conductive tips 381 will pierce the insulating plastic coating outside the wire to achieve the electric connection with the conductive wires in the cable.

Therefore, the wire holders 40 at both ends of the in-line slide dimming switch 1 are provided for connecting a power cable. One of the power cables is connected to the lamp holder, and the other power cable is connected to a power supply (such as the Mains Power). Power enters into the in-line slide dimming switch 1 through the connected wire holder 40, and the switch and dimming circuit 31 and the slide member 33 of the printed circuit board 30 are provided for the dimming effect to adjust the light emitting brightness of a dimmable energy-saving fluorescent bulb or a dimmable LED bulb installed on the lamp holder.

In view of the description above, the present invention primarily installs the switch and dimming circuit on the printed circuit board inside the in-line slide dimming switch and operated with the dimmable energy-saving fluorescent bulb and the dimmable LED bulb. The connected lamp holder may be used for installing and using the dimmable energy-saving fluorescent bulb and the dimmable LED bulb directly to achieve the effect of adjusting the brightness of the emitting light of the dimmable energy-saving fluorescent bulb and the dimmable LED bulb installed on the lamp holder by the in-line slide dimming switch. In addition, the present invention also provides the effect of installing the electric wires to the wire holders conveniently to achieve the effects of shortening the assembling procedure, and improving the assembling efficiency and market competitiveness.

What is claimed is:

1. An in-line slide dimming switch comprising a base, a cover, a printed circuit board and first and second wire holders, wherein the base is a casing with a hollow formed at a top of the base, with a first accommodating space formed inside the base, with first and second pivoting frames formed separately at left and right ends of the base, with a second accommodating space penetrating from the top to the bottom in each pivoting frame and passing out from an outer side of the base, with a separating ridge formed at a center of a surface of an inner sidewall and extended from the top to the bottom of each pivoting frame, with first and second latching ridges transversally disposed on an outer surface of the base, with a pivoting slot formed at a bottom edge of both sidewalls of each pivoting frame; wherein the cover is a casing with a hollow formed at a bottom of the cover and covered and engaged with the base, wherein a third accommodating space is formed in the cover, and wherein a longitudinal slide slot is formed at a top of third accommodating space with a groove formed on each of left and right end surfaces of the third accommodating space; wherein the printed circuit board has a switch and dimming circuit and a potentiometer electrically coupled to each other, wherein the potentiometer adjusts an electric potential of a sliding handle situated at a position higher than the printed circuit board, wherein a pushing member of a slide member is pushed to drive the sliding handle to move, wherein first and second accommodating recesses are formed at left and right ends of the printed circuit board and large enough to frame the first and second pivoting frames, wherein a conductive plate is installed above the first and second accommodating recesses and electrically coupled to the switch and dimming circuit, and wherein first and second conductive tips are formed and extend outwardly from the conductive plate; wherein the printed circuit board is installed horizontally into first accommodating space of the base, wherein first and second pivoting shafts extend out from each wire holder to enter into the pivoting slots of the first and second pivoting frames to define a pivoting vertical status and a horizontal status, wherein an inner sidewall is disposed above the first and second pivoting shafts and has a separating ridge formed at a center of an outer side of the inner sidewall; wherein an outer end of a bottom wall of each wire holder extends upward to form an outer sidewall, wherein a latching edge is formed at an inner edge of the outer sidewall; wherein a block is coupled between the inner sidewall and the outer sidewall, and an insert hole is penetrated through the block, with the insert hole extending perpendicular to the inner sidewall, the outer sidewall and the separating ridge, with the inner sidewall, the outer sidewall and the separating ridge extending parallel to a corresponding one of the first and second conductive tips and the insert hole extending perpendicular to the corresponding one of the first and second conductive tips in the vertical status, with the inner sidewall, the outer sidewall and the separating ridge extending perpendicular to the corresponding one of the first and second conductive tips in the horizontal status and the insert hole extending parallel to the corresponding one of the first and second conductive tips in the horizontal status, with the latching edges of the first and second wire holders engaging the first and second latching ridges in the horizontal status and with the latching edges of the first and second wire holders spaced from the first and second latching ridges in the vertical status.

2. The in-line slide dimming switch according to claim 1, wherein the base has a through hole formed separately at four corners and penetrated from the top to a bottom of the base and a stepped surface having a height on an inner side greater than a height on an outer side of the base; wherein a downwardly hollow locking hole pillar is separately formed at four corners of the cover and has an inner thread formed therein, wherein a stepped surface of the cover is configured to be corresponsive to the stepped surface of the base, wherein each downwardly hollow locking hole pillar of the cover is configured to be corresponsive to a corresponding through hole of the base, wherein recesses at both ends of the cover are configured to be corresponsive to When an outer sidewall of the base and each downwardly hollow locking hole pillar is covered onto the base, wherein a pushing bump of the printed circuit board is protruded out from the longitudinal slide slot of the cover, and wherein connecting members are passed through the through holes of the base and locked with the downwardly hollow locking hole pillars of the cover.

3. The in-line slide dimming switch according to claim 1, wherein the base has a plurality of upwardly protruding support pillars disposed therein, and wherein when the printed circuit board is horizontally placed in the first accommodating space of the base, a bottom side of the printed circuit board sits on the plurality of upwardly protruding support pillars stably for positioning.

4. The in-line slide dimming switch according to claim 1, wherein each pivoting shaft of the wire holder has a bevel to facilitate entering the base into the pivoting slot of the base by a rotary motion.

5. The in-line slide dimming switch according to claim 1, wherein a top of the inner edge of the outer sidewall of the wire holder is formed to be a bevel and a though hole is formed at the bottom wall of the wire holder.

6. The in-line slide dimming switch according to claim 5, wherein the latching edge on the outer sidewall of the wire holder is formed at an inner top edge of the through hole of the wire holder.

* * * * *